US012729850B2

(12) United States Patent
Cadima

(10) Patent No.: US 12,729,850 B2
(45) Date of Patent: Sep. 8, 2026

(54) GAS BURNER ASSEMBLY FOR A COOKTOP APPLIANCE

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 328 days.

(21) Appl. No.: 18/462,637

(22) Filed: Sep. 7, 2023

(65) Prior Publication Data

US 2025/0084991 A1 Mar. 13, 2025

(51) Int. Cl.
*F23D 14/06* (2006.01)
*F23D 23/00* (2006.01)
*F24C 3/08* (2006.01)

(52) U.S. Cl.
CPC ..... *F23D 14/06* (2013.01); *F23D 23/00* (2013.01); *F24C 3/085* (2013.01)

(58) Field of Classification Search
CPC ..... F23D 23/00; F23D 14/06; F23D 14/26
USPC ..... 126/39 E, 39 R
See application file for complete search history.

(56) References Cited

U.S. PATENT DOCUMENTS 5,133,658 A 7/1992 Le Monnier De Gouville et al.
5,464,004 A 11/1995 Maughan
5,492,469 A 2/1996 Oda et al.
7,841,332 B2 11/2010 Pottenger et al.
8,863,735 B2 * 10/2014 Cadima ..... F24C 3/085 431/350
9,453,641 B2 9/2016 Cadima
10,344,969 B2 7/2019 Fowler et al.
2009/0205630 A1 * 8/2009 Pottenger ..... F24C 3/085 431/350
2013/0174837 A1 7/2013 Cadima

FOREIGN PATENT DOCUMENTS

EP 0932797 B1 10/2003

* cited by examiner

*Primary Examiner* — Vivek K Shirsat
(74) *Attorney, Agent, or Firm* — Dority & Manning, P.A.

(57) ABSTRACT

A gas burner for a cooktop appliance includes a base extending along a radial direction and a circumferential direction, the base defining a mixture inlet therethrough along an axial direction; an outer wall extending from the base along the axial direction, the outer wall and the base collectively forming a fuel chamber; a plurality of flame ports defined within the outer wall, the fuel chamber being in fluid communication with the plurality of flame ports; a simmer flame chamber positioned at the outer wall radially outward from the mixture inlet; a conduit formed between the simmer flame chamber and the mixture inlet, the conduit extending along the radial direction and defining a conduit inlet proximate the mixture inlet and a conduit outlet proximate the simmer flame chamber; and a fuel supply system positioned proximate the mixture inlet.

12 Claims, 6 Drawing Sheets

GAS BURNER ASSEMBLY FOR A COOKTOP APPLIANCE

FIELD OF THE INVENTION

The present subject matter relates generally to gas burner assemblies, and more particularly to flame stabilization in gas burner assemblies.

BACKGROUND OF THE INVENTION

Gas burners are commonly used on the cooktops of household gas cooking appliances including e.g., range ovens and cooktop appliances built into cabinetry. For example, gas cooktops traditionally have at least one gas burner positioned at a cooktop surface for use in heating or cooking an object, such as a cooking utensil and its contents. Gas burners generally include an orifice that directs a flow of gaseous fuel into a fuel chamber. Between the orifice and the fuel chamber, the gaseous fuel entrains air, and the gaseous fuel and air mix within the fuel chamber before being discharged and ignited out of the fuel chamber through a plurality of flame ports.

Some gas burner assemblies include certain features for maintaining a flame when pressure disturbances may extinguish the flames present at each of the flame ports. However, existing features have several drawbacks. For one example, existing designs can result in excessively large flames on one side of the burner, resulting in uneven heating of cooking utensils. For another example, existing designs may fail to account for manufacturing tolerances of parts to ensure a proper amount of air/fuel mixture is being supplied for maintaining a simmer flame.

Accordingly, a gas burner assembly which obviates one or more of the above-mentioned drawbacks would be beneficial. In particular, a gas burner assembly which maintains a reliable and constant simmer flame would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a gas burner for a cooktop appliance is provided. The gas burner may include a base extending along a radial direction and a circumferential direction, the base defining a mixture inlet therethrough along the axial direction; an outer wall extending from the base along the axial direction, the outer wall and the base collectively forming a fuel chamber; a plurality of flame ports defined within the outer wall, the fuel chamber being in fluid communication with the plurality of flame ports; a simmer flame chamber positioned at the outer wall radially outward from the mixture inlet; a conduit formed between the simmer flame chamber and the mixture inlet, the conduit extending along the radial direction and defining a conduit inlet proximate the mixture inlet and a conduit outlet proximate the simmer flame chamber; and a fuel supply system positioned proximate the mixture inlet.

In another exemplary aspect of the present disclosure, a cooking appliance is provided. The cooking appliance may include a cabinet including a cooking chamber; a cooktop positioned above the cooking chamber; and a gas burner positioned within the cooktop, the gas burner defining an axial direction, a radial direction, and a circumferential direction. The gas burner may include a base extending along the radial direction and the circumferential direction, the base defining a mixture inlet therethrough along the axial direction; an outer wall extending from the base along the axial direction, the outer wall and the base collectively forming a fuel chamber; a plurality of flame ports defined within the outer wall, the fuel chamber being in fluid communication with the plurality of flame ports; a simmer flame chamber positioned at the outer wall radially outward from the mixture inlet; a conduit formed between the simmer flame chamber and the mixture inlet, the conduit extending along the radial direction and defining a conduit inlet proximate the mixture inlet and a conduit outlet proximate the simmer flame chamber; and a fuel supply system positioned proximate the mixture inlet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
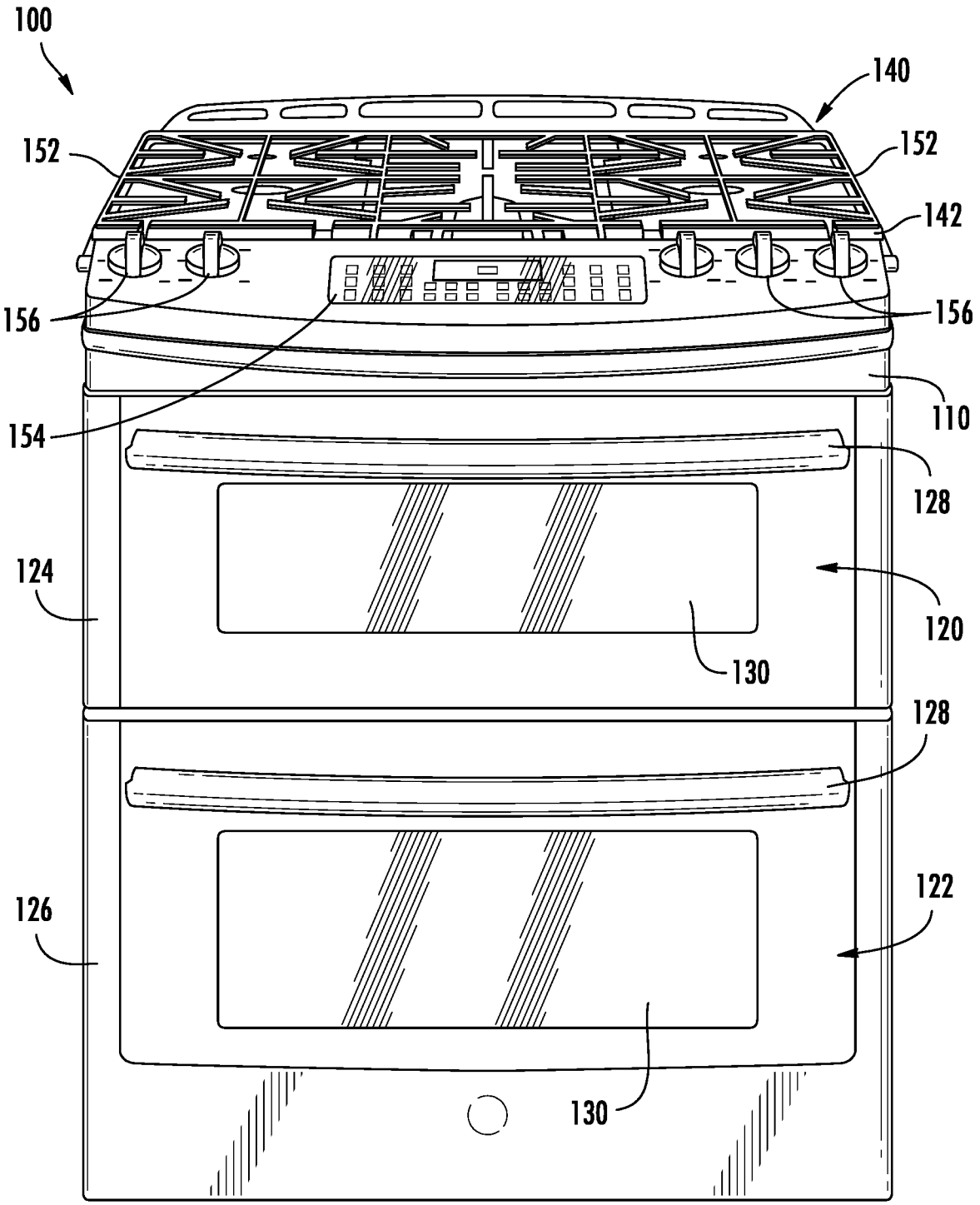
FIG. 1 provides a front, perspective view of a range appliance according to an example embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
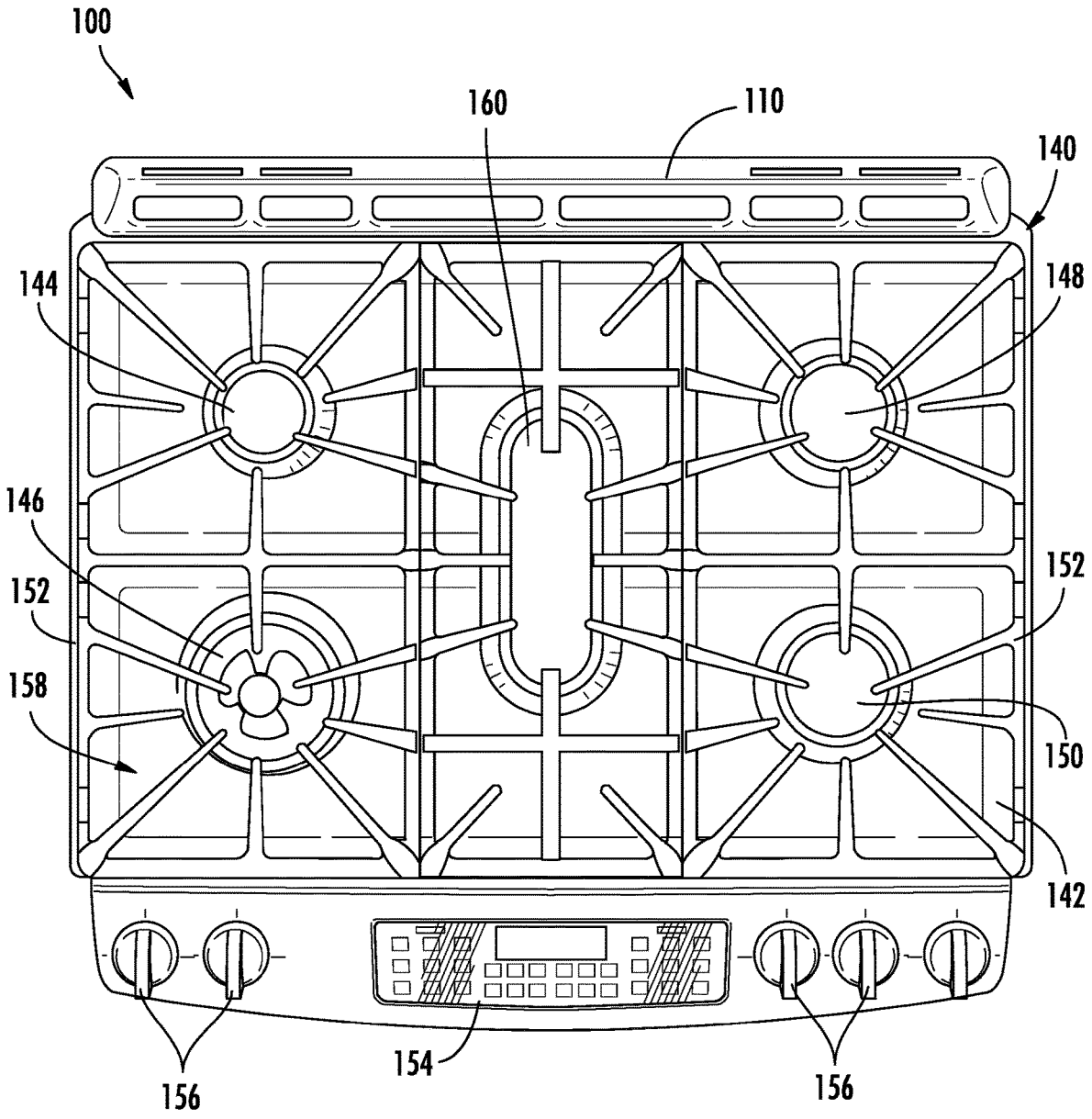
FIG. 2 provides a top, plan view of the example range appliance of FIG. 1.

Turning now to the figures, FIG. 1 provides a front, perspective view of a range appliance 100 as may be employed with the present disclosure. FIG. 2 provides a top, plan view of range appliance 100. Range appliance 100 includes an insulated cabinet 110. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present disclosure may be used in any suitable appliance (e.g., a single oven range appliance or a standalone cooktop appliance). Thus, the exemplary embodiment shown in FIG. 1 is not intended to limit the present disclosure to any particular cooking chamber configuration or arrangement.

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass windowpanes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof. Moreover, top panel 142 may be formed as a unitary, single piece or, alternatively, as multiple discrete pieces joined together.

For range appliance 100, a utensil holding food or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 1, burners assemblies 144, 146, 148, 150 can be configured in various sizes so as to provide, for example, for the receipt of cooking utensils (e.g., pots, pans, etc.) of various sizes and configurations and to provide different heat inputs for such cooking utensils. Grates 152 may be supported on a top surface 158 of top panel 142. In optional embodiments, range appliance 100 includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this exemplary embodiment, user interface panel 154 includes knobs 156 that are each associated with one of burner assemblies 144, 146, 148, 150 and griddle burner 160. Knobs 156 allow the user to activate each burner assembly and determine the amount of heat output provided by each burner assembly 144, 146, 148, 150 and griddle burner 160 to a cooking utensil located thereon. User interface panel 154 may also be provided with one or more graphical display devices that deliver certain information to the user such as, for example, whether a particular burner assembly is activated or the rate at which the burner assembly is set.

Although shown with knobs 156, it should be understood that knobs 156 and the configuration of range appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device designed to provide operational feedback to a user.

Turning now to FIGS. 3 through 7, various views are provided of a gas burner (or gas burner assembly) 200 according to exemplary embodiments of the present disclosure. As an example, gas burner 200 may be used in range appliance 100 (FIG. 2) as one of burner assemblies 144, 146, 148, 150. Nonetheless, it will be understood that, while describe in greater detail below in the context of range appliance 100, burner 200 may be used in or with any suitable appliance in alternative exemplary embodiments. Moreover, burner 200 may define an axial direction A, a radial direction R, and a circumferential direction C.

Figure 3:
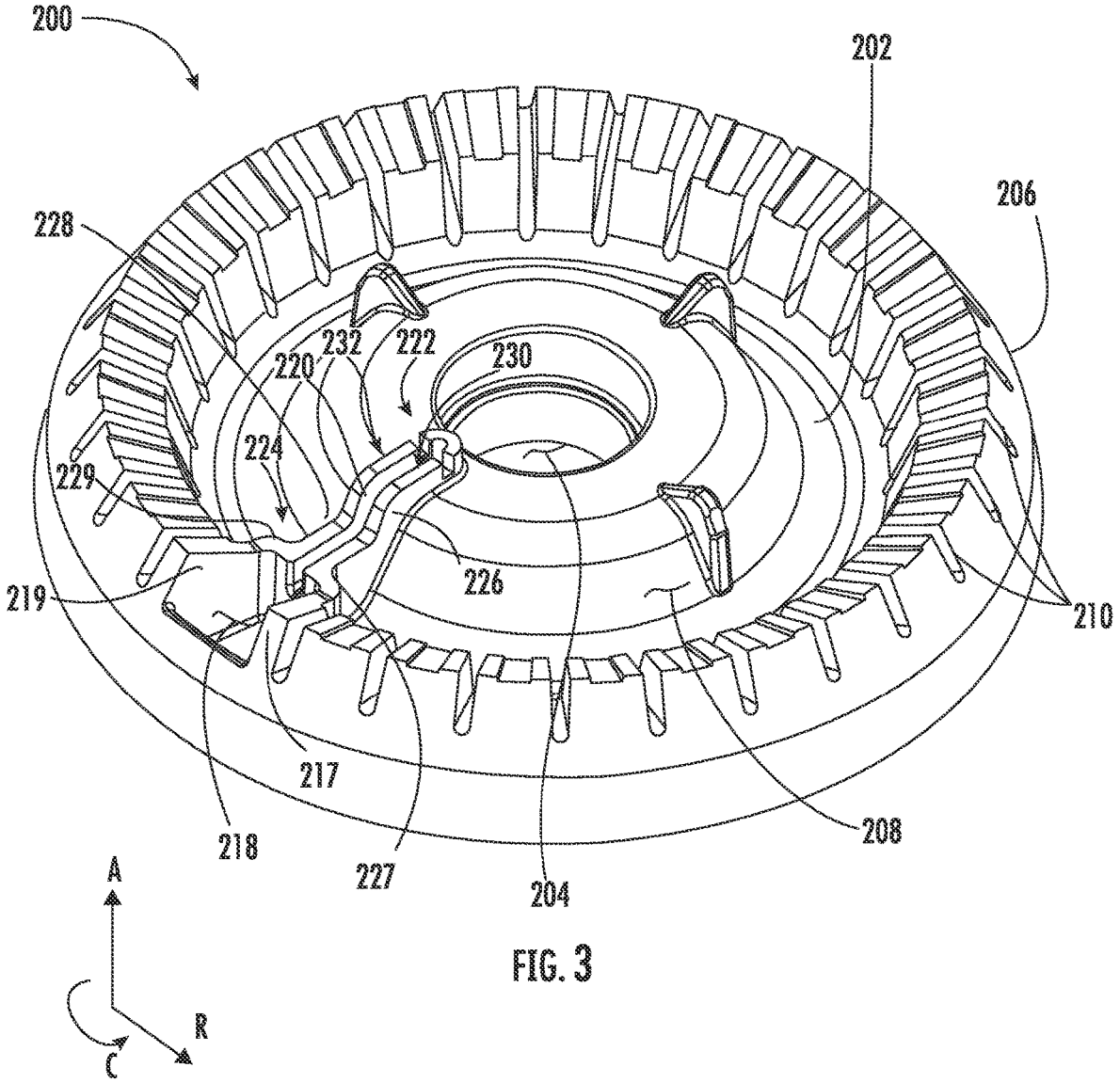
FIG. 3 provides a perspective view of a gas burner according to an exemplary embodiment of the present disclosure.
Figure 4:
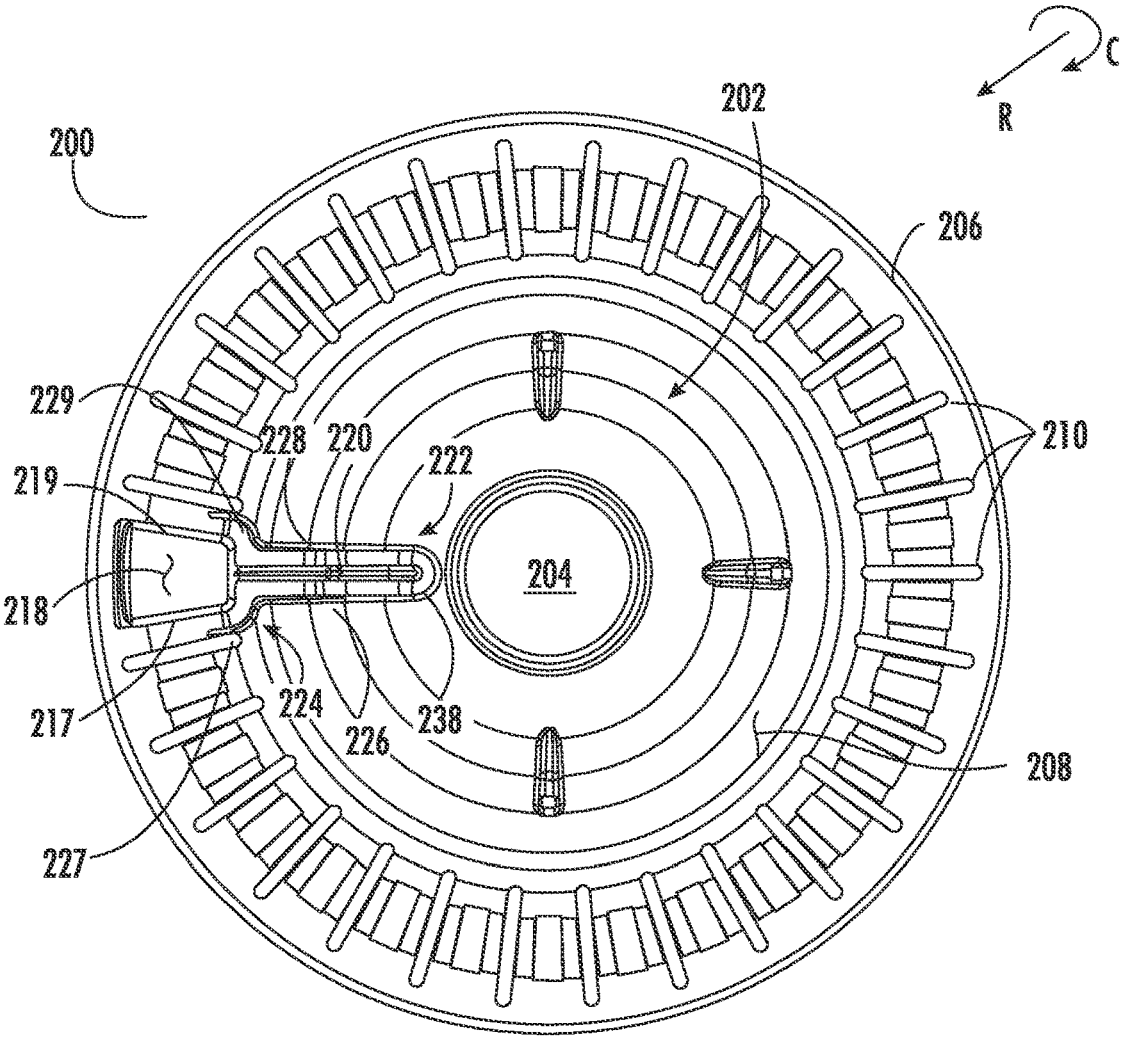
FIG. 4 provides a top view of the exemplary gas burner of FIG. 3.

As shown in FIGS. 3 and 4, gas burner assembly 200 may include a base or base body 202. Base 202 may be defined along the radial direction R and the circumferential direction C. For instance, base 202 may be predominantly circular (e.g., along the circumferential direction C). According to at least some embodiments, base 202 is donut-shaped. For example, a mixture inlet 204 may be defined at a center of base 202. Mixture inlet 204 may be an aperture defined through base 202 along the axial direction A. Thus, a flammable gas (e.g., air/fuel mixture) may be supplied to burner 200 via mixture inlet 204. As would be understood, a fuel supply system 201 may be included through which fuel (e.g., such as propane, natural gas, etc.) and air may be supplied to burner 200 for combustion to provide heat.

Gas burner 200 may include an outer wall 206. Outer wall 206 may extend from base 202 (e.g., predominantly along the axial direction A). Outer wall 206 may be provided at an outer perimeter of base 202 (e.g., radially outward from mixture inlet 204). Additionally or alternatively, outer wall 206 may protrude upward along the axial direction A (e.g., away from top panel 142 as seen in FIG. 1). Outer wall 206 may further define a thickness along the radial direction R. For instance, the thickness of outer wall 206 may be between about 10% and about 20% of a diameter of base 202. A fuel chamber 208 may thus be formed between base 202 and outer wall 206. As would be understood, the air/fuel mixture supplied through mixture inlet 204 may flow through fuel chamber 208.

Outer wall 206 may define a plurality of flame ports 210. Flame ports 210 may be formed into or through outer wall 206 along the radial direction R. Additionally or alternatively, flame ports 210 may be notched into outer wall 206 along the axial direction A (e.g., downward along the axial direction A). Each of the plurality of flame ports 210 may be in fluid communication with fuel chamber 208. Upon ignition, flames may formed through flame ports 210 (e.g., radially outward from outer wall 206). The plurality of flame ports 210 may be equally spaced out along the circumferential direction C along outer wall 206.

Figure 5:
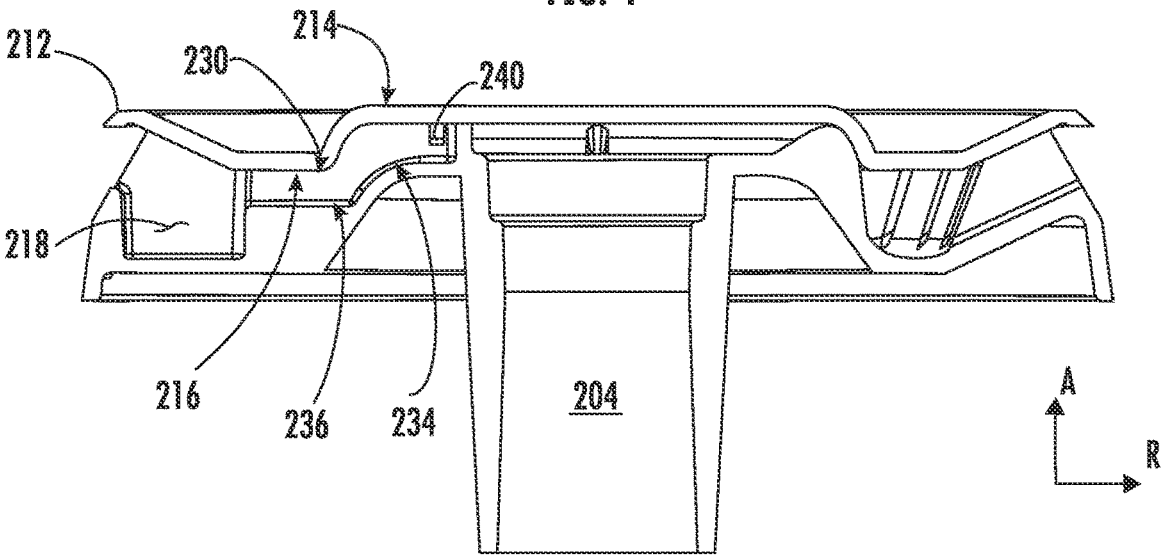
FIG. 5 provides a side section view of the exemplary gas burner of FIG. 3.
Figure 6:
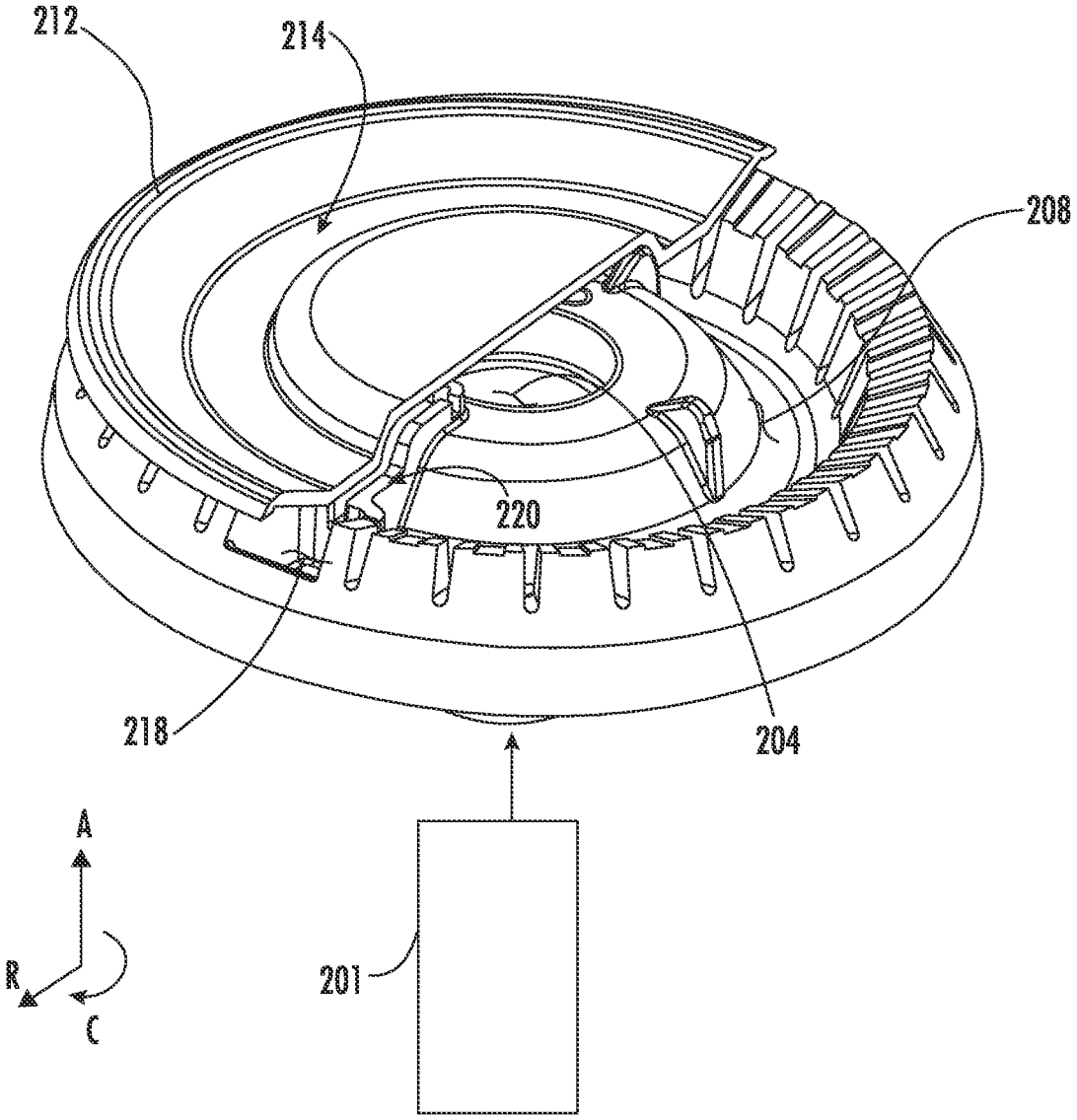
FIG. 6 provides a perspective view of the exemplary gas burner of FIG. 3 including a cutaway of a cap.
Figure 7:
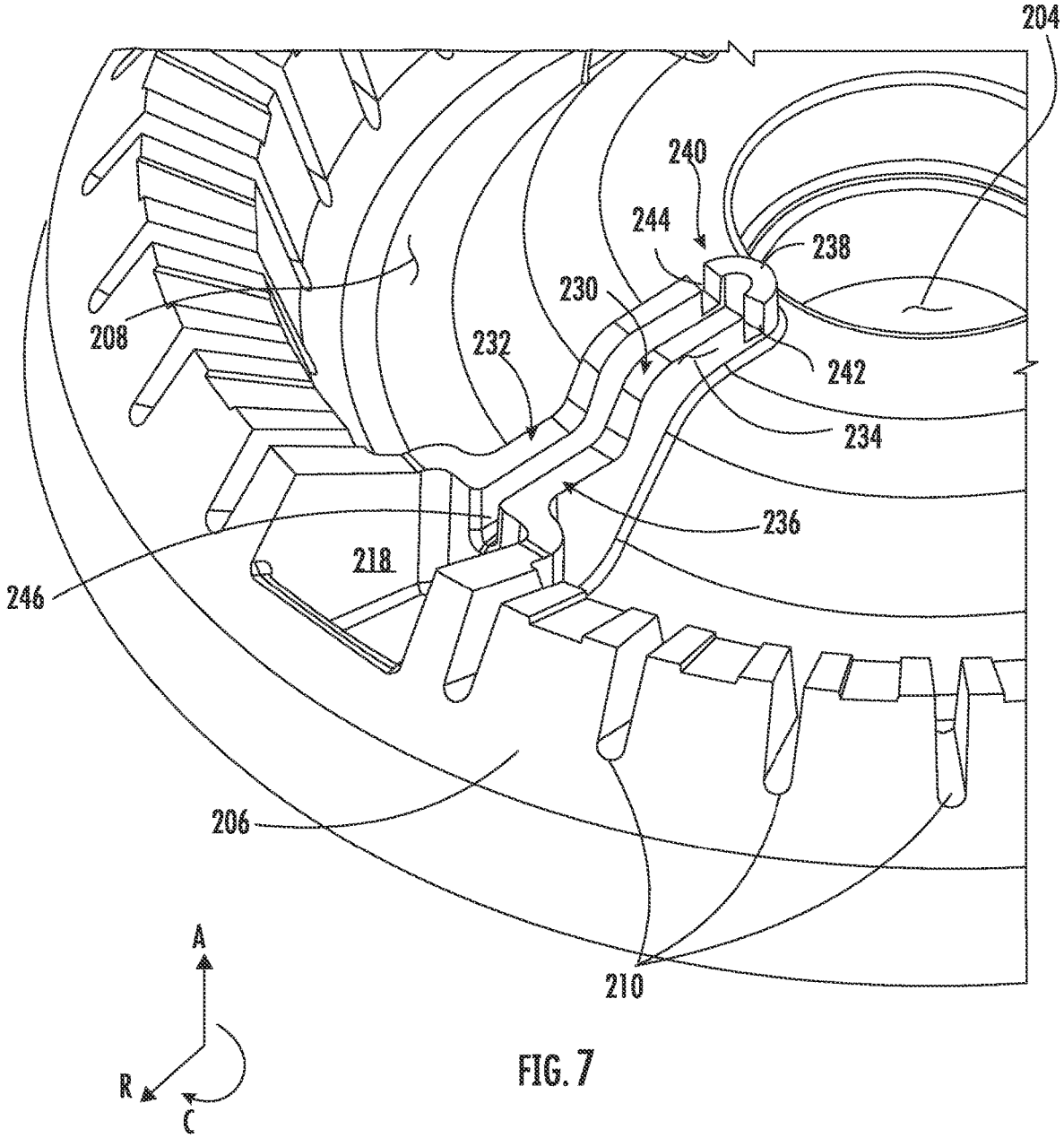
FIG. 7 provides a close-up perspective view of the exemplary gas burner of FIG. 3.

Gas burner 200 may further include a cap 212 (FIGS. 5 and 6). Cap 212 may be selectively positioned on base 202. For instance, cap 212 may contact a top edge of outer wall 206 (e.g., in an installed position). Accordingly, cap 212 may form an upper boundary of fuel chamber 208. Additionally or alternatively, cap 212 may for an upper boundary of each of the plurality of flame ports 210. Cap 212 may define a top face 214 and a bottom face 216. As would be understood, bottom face 216 selectively contacts outer wall 206 while top face 214 is exposed upward (e.g., along the axial direction A). As will be explained in more detail below, cap 212 may define a profile (e.g., along the radial direction R, as seen in FIG. 5). Accordingly, portions of cap 212 may be positioned higher or lower in the axial direction A along the radial direction R.

Gas burner 200 may include a simmer flame chamber 218. Simmer flame chamber 218 may be positioned at outer wall 206. For instance, simmer flame chamber 218 may be positioned radially outward from mixture inlet 204. Simmer flame chamber 218 may be in fluid communication with fuel chamber 208. Accordingly, the air/fuel mixture may be supplied to simmer flame chamber 218 (e.g., via a conduit, described below). Simmer flame chamber 218 may define a width (e.g., along the circumferential direction C), a height (e.g., along the axial direction A), and a depth (e.g., along the radial direction R). The width of simmer flame chamber 218 (e.g., between a first sidewall 217 and a second sidewall 219) may be greater than a width of flame port 210. For instance, the width of simmer flame chamber 218 may be between about 4 times and about 6 times greater than the width of flame port 210. Accordingly, a volume of flame chamber 218 may be greater than a volume of flame port 210. Advantageously, a predetermined amount of air/fuel mixture may be contained within simmer flame chamber at a lower pressure and lower velocity relative to the air/fuel mixture provided within fuel chamber 208.

Gas burner 200 may include a conduit 220. Conduit 220 may fluidly connect simmer flame chamber 218 with fuel chamber 208. For instance, conduit 220 may extend along the radial direction R. According to some embodiments, conduit 220 extends between mixture inlet 204 and simmer flame chamber 218. Accordingly, a proximal end 222 of conduit 220 may be positioned adjacent to mixture inlet 204. The air/fuel mixture may flow from mixture inlet 204 to simmer flame chamber 218 via conduit 220. For instance, the air/fuel mixture may enter fuel chamber 208 from mixture inlet 204 before flowing into proximal end 222 of conduit 220. A distal end 224 of conduit 220 may be positioned adjacent to simmer flame chamber 218. For instance, conduit 220 may be fluidly connected with simmer flame chamber 218. As seen in FIG. 3, the air/fuel mixture may flow directly into simmer flame chamber 218 from distal end 224 of conduit 220.

Conduit 220 may include a first wall 226 and a second wall 228. First wall 226 and second wall 228 may be predominantly parallel with each other. For instances, each of first wall 226 and second wall 228 may extend predominantly along the radial direction R (e.g., from mixture inlet 204 to simmer flame chamber 218). According to at least some embodiments, a cross-section of conduit 220 is relatively constant along the radial direction R. Thus, the cross-section of conduit 220 at proximal end 222 is approximately equal to the cross-section of conduit 220 at distal end 224.

Conduit 220 may include a first flange 227. First flange 227 may extend from a distal end of first wall 226. For instance, first flange 227 may extend predominantly along the circumferential direction C from the distal end of first wall 226 away from second wall 228. Conduit 220 may include a second flange 229. Second flange 229 may extend from a distal end of second wall 226. For instance, second flange 229 may extend predominantly along the circumferential direction C from the distal end of second wall 228 away from first wall 226. Each of first flange 227 and second flange 229 may partially form simmer flame chamber 218. For instance, first flange 227 may connect with first sidewall 217 of simmer flame chamber 218, while second flange 229 may connect with second sidewall 219 of simmer flame chamber 218. Thus, the width of conduit 220 may be less than the width of simmer flame chamber 218 along the circumferential direction C.

Conduit 220 may define a top surface. In detail, first wall 226 may include a first top surface 230 and second wall 228 may include a second top surface 232. Each of first top surface 230 and second top surface 232 may be positioned at a predefined height along the axial direction A. Each of first top surface 230 and second top surface 232 may selectively contact bottom face 216 of cap 212 (e.g., when cap 212 is in the installed position). Additionally or alternatively, as shown in FIG. 5, conduit 220 may define an axial profile. Thus, conduit 220 may include a first section 234 extending from the mixture inlet (e.g., from proximal end 222) at a first height along the axial direction A (or a vertical direction). Conduit 220 may further include a second section 236 extending at a second height along the axial direction A (or the vertical direction). Second section 236 may extend from a distal end of first section 234. For instance, first section 234 and second section 236 may be connected to form a single uninterrupted flow conduit. Additionally or alternatively, the second height may be below the first height. Accordingly, first section 234 may be positioned higher (e.g., along the axial direction A) than second section 236. As would be understood, cap 212 may define a matching profile (e.g., axial profile). Thus, bottom surface 216 of cap 212 may be in contact with first top surface 230 and second top surface 232 along an entire radial length of first wall 226 and second wall 228.

Conduit 220 may include a rear wall 238. Rear wall 238 may form a proximal barrier of conduit 220 (e.g., adjacent to mixture inlet 204). Rear wall 238 may have a curved shape (e.g., convex toward mixture inlet 204). Rear wall 238 may contact bottom surface 216 of cap 212 (e.g., when cap 212 is in the installed position). As will be described, rear wall 238 may be separated from each of first wall 226 and second wall 228 (e.g., along the radial direction R).

Conduit 220 may include a conduit inlet 240. For instance, conduit inlet 240 may provide fluid communication between fuel chamber 208 and conduit 220. Conduit inlet 240 may be formed between first wall 226 and rear wall 238. Additionally or alternatively, conduit inlet 240 may be formed between second wall 228 and rear wall 238. Thus, the air/fuel mixture may flow into conduit 220 from fuel chamber 208 via conduit inlet 240.

Conduit inlet 240 may include a first conduit inlet 242 and a second conduit inlet 244. First conduit inlet 242 may be formed through first wall 226. First conduit inlet 242 may be formed along the circumferential direction C. For instance, the air/fuel mixture may flow from fuel chamber 208 into conduit 220 along the circumferential direction C through first conduit inlet 242. Similarly, second conduit inlet 244 may be formed through second wall 228. Second conduit inlet 244 may be formed along the circumferential direction C. For instance, the air/fuel mixture may flow from fuel chamber 208 into conduit 220 along the circumferential direction C through second conduit inlet 244. Second conduit inlet 244 may be formed opposite first conduit inlet 242. For instance, first conduit inlet 242 and second conduit inlet 244 may be placed at equal radial distances from mixture inlet 204.

Conduit inlet 240 may define an inlet area. For instance, the inlet area may be a cross-sectional area of first conduit inlet 242 and a cross-sectional area of second conduit inlet 244 added together. For instances, when cap 212 is in the installed position, the inlet area may be a height (e.g., along the axial direction A) of first conduit inlet 242 and second conduit inlet 244 and a width (e.g., along the radial direction R) of first conduit inlet 242 and second conduit inlet 244.

Conduit 220 may include a conduit outlet 246. Conduit outlet 246 may be defined at distal end 224 of conduit 220. The air/fuel mixture may flow from conduit 220 into simmer flame chamber 218 via conduit outlet 246. Conduit outlet 246 may define a cross-sectional area. For instance, the cross-sectional area of conduit outlet 246 may be a height along the axial direction A and a width along the circumferential direction (as would be understood). In particular, the cross-sectional area of conduit outlet 246 may be less than or equal to the cross-sectional area of conduit inlet 240 (e.g., first conduit inlet 242 and second conduit inlet 244 together). Advantageously, the flow of the air/fuel mixture from conduit 220 into simmer flame chamber 218 may be restricted according to the cross-sectional area of conduit outlet 246. Thus, in the instance that a manufacturing gap is formed between cap 212 and first wall 226 and/or second wall 228, additional or accelerated air/fuel mixture is restricted from entering simmer flame chamber 218 according to the cross-sectional area of conduit outlet 246.

As mentioned above, the width of simmer flame chamber 218 may be greater than the width of conduit 220. Accordingly, a volume of simmer flame chamber 218 may be relatively large compared to conduit 220. When the air/fuel mixture flows into simmer flame chamber 218, a velocity and pressure thereof are reduced. When a heating input to the gas burner 200 is turned to a high level, a resulting flame within simmer flame chamber 218 may be reduced due to a pressure difference between simmer flame chamber 218 and fuel chamber 208. Similarly, when the heating input to gas burner 200 is turned to a low level, the resulting flame within simmer flame chamber 218 may be relatively higher as more air/fuel mixture is fed to simmer flame chamber 218. Accordingly, the flame within simmer flame chamber 218 may be maintained at any input or power level, resulting in easy relighting of gas burner 200 in the case of power outages from dynamic pressure disturbances.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas burner for a cooktop appliance, the gas burner defining an axial direction, a radial direction, and a circumferential direction, the gas burner comprising:

a base extending along the radial direction and the circumferential direction, the base defining a mixture inlet therethrough along the axial direction;

an outer wall extending from the base along the axial direction, the outer wall and the base collectively forming a fuel chamber;

a plurality of flame ports defined within the outer wall, the fuel chamber being in fluid communication with the plurality of flame ports;

a simmer flame chamber positioned at the outer wall radially outward from the mixture inlet;

a conduit formed between the simmer flame chamber and the mixture inlet, the conduit extending along the radial direction and defining a conduit inlet proximate the mixture inlet and a conduit outlet proximate the simmer flame chamber, the conduit comprising:

a first wall extending along the radial direction from the mixture inlet to the outer wall, wherein a first conduit inlet of the conduit inlet is formed through the first wall along the circumferential direction;

a second wall extending along the radial direction from the mixture inlet to the outer wall, the second wall being predominantly parallel with the first wall, wherein a second conduit inlet of the conduit inlet is formed through the second wall along the circumferential direction;

a first section extending outward in the radial direction from the first conduit inlet or the second conduit inlet at a first vertical height; and a second section extending outward in the radial direction from a distal end of the first section at a second vertical height, the second vertical height being below the first vertical height; and a fuel supply system positioned proximate the mixture inlet.

2. The gas burner of claim 1, wherein a cross-sectional area of the conduit inlet is greater than or equal to a cross-sectional area of the conduit outlet.

3. The gas burner of claim 1, wherein the conduit comprises:

a first flange extending from a distal end of the first wall along the circumferential direction away from the second wall.

4. The gas burner of claim 1, further comprising:

a cap selectively positioned over the base along the axial direction.

5. The gas burner of claim 4, wherein a top surface of the first wall and a top surface of the second wall each contact a bottom face of the cap such that the conduit is defined by the first wall, the second wall, the base, and the cap.

6. The gas burner of claim 1, wherein a width of the simmer flame chamber along the circumferential direction is greater than a width of the conduit outlet.

7. A cooking appliance comprising:

a cabinet comprising a cooking chamber;

a cooktop positioned above the cooking chamber; and a gas burner positioned within the cooktop, the gas burner defining an axial direction, a radial direction, and a circumferential direction, the gas burner comprising:

a base extending along the radial direction and the circumferential direction, the base defining a mixture inlet therethrough along the axial direction;

an outer wall extending from the base along the axial direction, the outer wall and the base collectively forming a fuel chamber;

a plurality of flame ports defined within the outer wall, the fuel chamber being in fluid communication with the plurality of flame ports;

a simmer flame chamber positioned at the outer wall radially outward from the mixture inlet;

a conduit formed between the simmer flame chamber and the mixture inlet, the conduit extending along the radial direction and defining a conduit inlet proximate the mixture inlet and a conduit outlet proximate the simmer flame chamber, the conduit comprising:

a first wall extending along the radial direction from the mixture inlet to the outer wall, wherein a first conduit inlet of the conduit inlet is formed through the first wall along the circumferential direction;

a second wall extending along the radial direction from the mixture inlet to the outer wall, the second wall being predominantly parallel with the first wall, wherein a second conduit inlet of the conduit inlet is formed through the second wall along the circumferential direction;

a first section extending outward in the radial direction from the first conduit inlet or the second conduit inlet at a first vertical height; and a second section extending outward in the radial direction from a distal end of the first section at a second vertical height, the second vertical height being below the first vertical height; and a fuel supply system positioned proximate the mixture inlet.

8. The cooking appliance of claim 7, wherein a cross-sectional area of the conduit inlet is greater than or equal to a cross-sectional area of the conduit outlet.

9. The cooking appliance of claim 7, wherein the conduit comprises:

a first flange extending from a distal end of the first wall along the circumferential direction away from the second wall.

10. The cooking appliance of claim 7, wherein the gas burner further comprises:

a cap selectively positioned over the base along the axial direction.

11. The cooking appliance of claim 10, wherein a top surface of the first wall and a top surface of the second wall each contact a bottom face of the cap such that the conduit is defined by the first wall, the second wall, the base, and the cap.

12. The cooking appliance of claim 7, wherein a width of the simmer flame chamber along the circumferential direction is greater than a width of the conduit outlet.

* * * * *